US006959850B2

(12) United States Patent
Taylor et al.

(10) Patent No.: US 6,959,850 B2
(45) Date of Patent: Nov. 1, 2005

(54) TOOL-LESS DEPTH ADJUSTMENT FOR FASTENER-DRIVING TOOL

(75) Inventors: Walter J. Taylor, McHenry, IL (US); William J. Heinzen, Glenview, IL (US); Barry C. Walthall, Wheeling, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/809,181

(22) Filed: Mar. 25, 2004

(65) Prior Publication Data

US 2005/0189390 A1 Sep. 1, 2005

Related U.S. Application Data

(60) Provisional application No. 60/548,467, filed on Feb. 27, 2004.

(51) Int. Cl.[7] ..... B25C 1/00
(52) U.S. Cl. ..... 227/8; 227/107; 227/142
(58) Field of Search ..... 227/8, 9, 107, 227/119, 142

(56) References Cited

U.S. PATENT DOCUMENTS

| | | | | |
|---|---|---|---|---|
| 4,767,043 | A | 8/1988 | Canlas, Jr. | |
| 5,219,110 | A | 6/1993 | Mukoyama | |
| 5,261,587 | A | 11/1993 | Robinson | |
| 5,385,286 | A | 1/1995 | Johnson, Jr. | |
| 5,564,614 | A | 10/1996 | Yang | |
| 5,579,977 | A | 12/1996 | Yang | |
| 5,685,473 | A | 11/1997 | Shkolnikov et al. | |
| 6,012,622 | A | 1/2000 | Weinger et al. | |
| 6,170,729 | B1 | 1/2001 | Lin | |
| 6,186,386 | B1 | 2/2001 | Canlas et al. | |
| 6,209,770 | B1 * | 4/2001 | Perra | 227/8 |
| 6,783,044 | B2 * | 8/2004 | Perra et al. | 227/8 |
| 6,789,718 | B2 * | 9/2004 | Canlas et al. | 227/130 |
| 2002/0108997 | A1 | 8/2002 | Miller et al. | |
| 2002/0121540 | A1 | 9/2002 | Taylor et al. | |

* cited by examiner

*Primary Examiner*—Scott A. Smith
*Assistant Examiner*—Gloria R. Weeks
(74) *Attorney, Agent, or Firm*—Lisa M. Soltis; Mark W. Croll; Greer, Burns & Crain, Ltd.

(57) ABSTRACT

An adjustable depth of drive assembly for use with a fastener driving tool includes a workpiece contact element having a contact end and an adjustment end, a cage stop securable to the tool and being movable between an adjusting position in which the workpiece contact element is movable relative to the tool and a locked position wherein the adjustment end is secured to the tool, and a locking device associated with the cage stop and reciprocable between a locked position and an adjustment position for securing the cage stop and the adjustment end in a selected locked position relative to the tool without the use of tools. It is preferred that the adjustment end of the workpiece contact element has at least one toothed edge, and the cage stop has at least one toothed surface for engaging the at least one toothed edge in the locked position.

17 Claims, 5 Drawing Sheets

TOOL-LESS DEPTH ADJUSTMENT FOR FASTENER-DRIVING TOOL

This application claims benefit of provisional application 60/548,467 filed Feb. 27, 2004.

BACKGROUND OF THE INVENTION

The present invention relates generally to fastener-driving tools used to drive fasteners into workpieces, and specifically to combustion-powered fastener-driving tools, also referred to as combustion tools. More particularly, the present invention relates to improvements in a device or assembly which adjusts the depth of drive of the tool.

As exemplified in Nikolich, U.S. Pat. Re. No. 32,452, and U.S. Pat. Nos. 4,552,162; 4,483,473; 4,483,474; 4,404,722; 5,197,646; 5,263,439; 5,558,264 and 5,678,899 all of which are incorporated by reference, fastening tools, and particularly, portable combustion powered tools for use in driving fasteners into workpieces are described. Such fastener-driving tools are available commercially from ITW-Paslode (a division of Illinois Tool Works, Inc.) of Vernon Hills, Ill., under the IMPULSE® brand.

Such tools incorporate a generally gun-shaped tool housing enclosing a small internal combustion engine. The engine is powered by a canister of pressurized fuel gas, also called a fuel cell. A battery-powered electronic power distribution unit produces the spark for ignition, and a fan located in the combustion chamber provides for both an efficient combustion within the chamber, and facilitates scavenging, including the exhaust of combustion by-products. The engine includes a reciprocating piston having an elongate, rigid driver blade disposed within a piston chamber of a cylinder body.

The wall of a combustion chamber is axially reciprocable about a valve sleeve and, through a linkage, moves to close the combustion chamber when a workpiece contact element at the end of a nosepiece connected to the linkage is pressed against a workpiece. This pressing action also triggers a fuel metering valve to introduce a specified volume of fuel gas into the closed combustion chamber from the fuel cell.

Upon the pulling of a trigger, which causes the ignition of a charge of gas in the combustion chamber of the engine, the piston and driver blade are shot downward to impact a positioned fastener and drive it into the workpiece. As the piston is driven downward, a displacement volume enclosed in the piston chamber below the piston is forced to exit through one or more exit ports provided at a lower end of the cylinder. After impact, the piston then returns to its original, or "ready" position through differential gas pressures within the cylinder. Fasteners are fed into the nosepiece from a supply assembly, such as a magazine, where they are held in a properly positioned orientation for receiving the impact of the driver blade. The power of the tools differs according to the length of the piston stroke, volume of the combustion chamber, fuel dosage and similar factors.

Combustion powered tools have been successfully applied to large workpieces requiring large fasteners, for framing, roofing and other heavy duty applications. Smaller workpiece and smaller fastener trim applications demand a different set of operational characteristics than the heavy-duty, "rough-in", and other similar applications. Other types of fastener driving tools such as pneumatic, powder activated and/or electrically powered tools are well known in the art, and are also contemplated for use with the present depth of drive adjustment assembly.

One operational characteristic required in fastener driving applications, particularly trim applications, is the ability to predictably control fastener driving depth. For the sake of appearance, some trim applications require fasteners to be countersunk below the surface of the workpiece, others require the fasteners to be sunk flush with the surface of the workpiece, and some may require the fastener to stand off above the surface of the workpiece. Depth adjustment has been achieved in pneumatically powered and combustion powered tools through a tool controlling mechanism, referred to as a drive probe, that is movable in relation to the nosepiece of the tool. Its range of movement defines a range for fastener depth-of-drive. Similar depth of drive adjustment mechanisms are known for use in combustion type framing tools.

A conventional arrangement for depth adjustment involves the use of respective overlapping plates or tongues of a workpiece contact element and a wire form or valve linkage. At least one of the plates is slotted for sliding relative length adjustment. Threaded fasteners such as cap screws are employed to releasably secure the relative position of the plates together. The depth of fastener drive is adjusted by changing the length of the workpiece contact element relative to the wire form. Once the desired depth is achieved, the fasteners are tightened.

It has been found that users of such tools are inconvenienced by the requirement for an Allen wrench, nut driver, screwdriver or comparable tool for loosening the fasteners, then retightening them after length adjustment has been completed. In operation, it has been found that the extreme shock forces generated during fastener driving cause the desired and selected length adjustment to loosen and vary. Thus, the fasteners must be monitored for tightness during tool use.

To address the problem of maintaining adjustment, grooves or checkering have been added to the opposing faces of the overlapping plates to increase adhesion when the fasteners are tightened. However, to maintain the strength of the components in the stressful fastener driving environment, the grooves have not been made sufficiently deep to provide the desired amount of adhesion. Deeper grooves could be achieved without weakening the components by making the plates thicker, but that would add weight to the linkage, which is undesirable.

Other attempts have been made to provide tool-less depth of drive adjustment, but they have also employed the above-described opposing face grooves for additional adhesion, which is still prone to the adhesion problems discussed above.

Another design factor of such depth adjustment or depth of drive (used interchangeably) mechanisms is that the workpiece contact elements are often replaced over the life of the tool. As such, the depth adjustment mechanism preferably accommodates such replacement while retaining compatibility with the wire form, which is not necessarily replaced.

Accordingly, there is a need for a fastener driving tool depth of drive adjustment device or assembly where the adjustment is secured without the use of tools and is maintained during extended periods of fastener driving. There is also a need for a fastener depth adjustment device or assembly which provides for more positive fastening of the relative position of the workpiece contact element without reducing component strength.

BRIEF SUMMARY OF THE INVENTION

The above-listed needs are met or exceeded by the present tool-less depth adjustment assembly for a fastener-driving tool which overcomes the limitations of the current technology. Among other things, the present assembly is designed for more securely retaining the workpiece contact element relative to a wire form linkage during tool operation, while at the same time adjustable by the user without the use of tools.

More specifically, an adjustable depth of drive assembly for use with a fastener driving tool is provided and includes a workpiece contact element having a contact end and an adjustment end, a cage stop configured for being securable to the tool and being movable between an adjusting position in which the workpiece contact element is movable relative to the tool, and a locked position wherein the adjustment end is secured to the tool, a locking device associated with the cage stop and configured for being reciprocable between a locked position and an adjustment position for securing the cage stop and the adjustment end in a selected locked position relative to the tool without the use of tools, and at least one anchor lug, the locking device configured for engaging the at least one anchor lug in the locked position and being released from the at least one lug in the adjustment position.

In a preferred embodiment, the adjustment end of the workpiece contact element has at least one toothed edge, and the cage stop is configured for being securable to the tool and has at least one toothed surface for engaging the at least one toothed edge in the locked position.

DETAILED DESCRIPTION OF THE INVENTION

Figure 1:
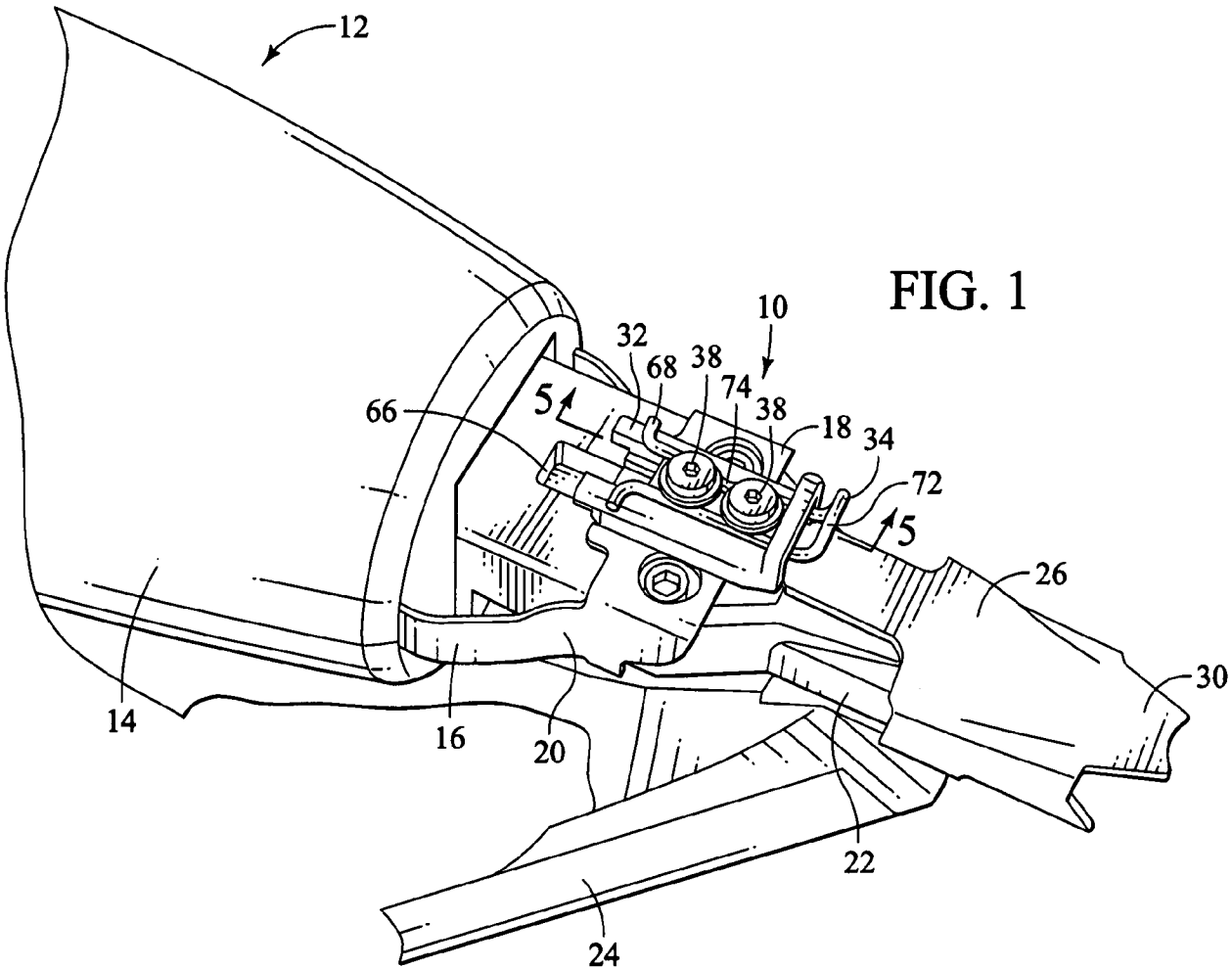
FIG. 1 is a fragmentary perspective view of a fastener driving tool equipped with the present depth adjustment assembly shown in a locked position.

Referring now to FIG. 1, an improved adjustable depth of drive assembly is generally designated 10, and is intended for use on a fastener driving tool of the type described above, and generally designated 12. The tool 12 includes a housing 14 enclosing a combustion chamber (not shown) and a reciprocating valve sleeve (not shown) connected to a wire form 16, including a platform portion or central portion 18 and a pair of elongate arms 20 which are connected at free ends to the valve sleeve as is known in the art. In the preferred embodiment, the wire form 16 is a metallic band and is fabricated by being stamped and formed in a single piece of metal, however, other rigid durable materials and fabrication techniques are contemplated.

Referring now to FIGS. 1–4, extending from the housing 14 is a nosepiece 22 configured for receiving fasteners from a magazine 24, also as is well known in the art. A workpiece contact element 26 is configured for reciprocal sliding movement relative to the nosepiece 22 and in the preferred embodiment, surrounds the nosepiece on at least three sides. The present depth of drive assembly 10 is configured for adjusting the relative position of the workpiece contact element 26 to the wire form 16, which in turn alters the relative position of the workpiece contact element to the nosepiece 22. Generally speaking, as the nosepiece 22 is brought closer to the workpiece surface, fasteners driven by the tool 12 are driven deeper into the workpiece.

A tongue portion or adjustment end 28 of the workpiece contact element 26 is opposite a contact end 30 which contacts a workpiece surface into which the fastener is to be driven, as is known in the art.

Figure 2:
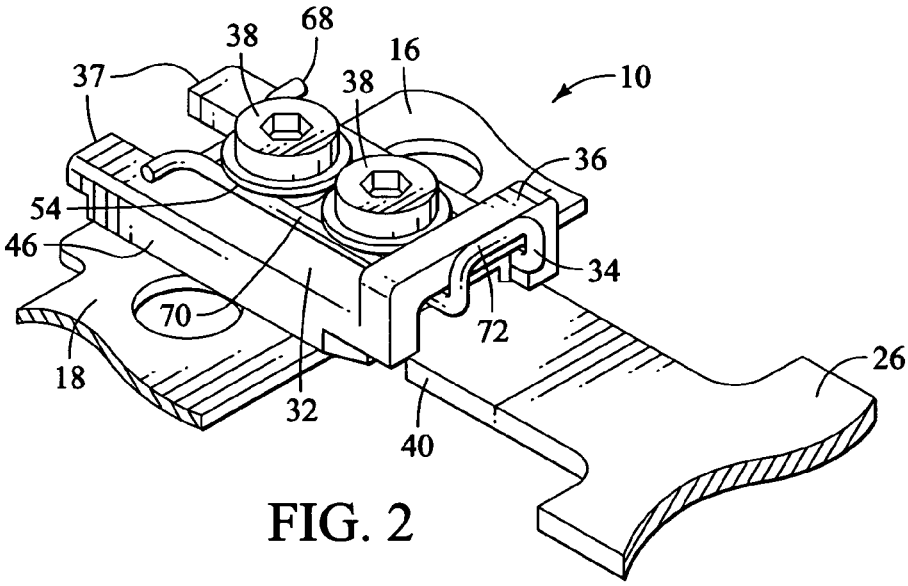
FIG. 2 is an enlarged fragmentary perspective view of the fastener driving tool of FIG. 1.
Figure 3:
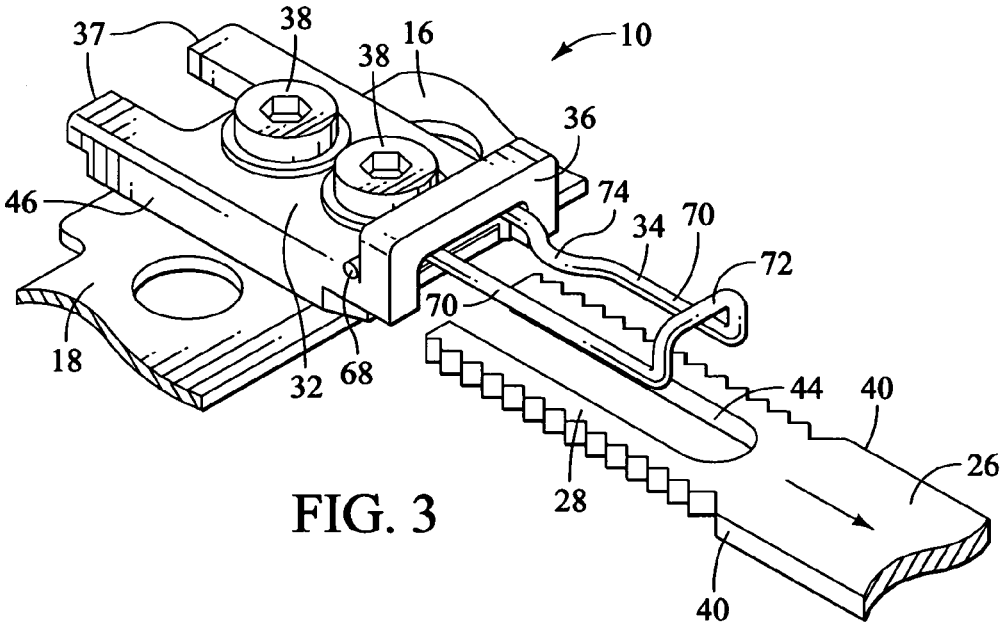
FIG. 3 is a fragmentary exploded view of the assembly of FIG. 2 shown in the adjustment position.
Figure 5:
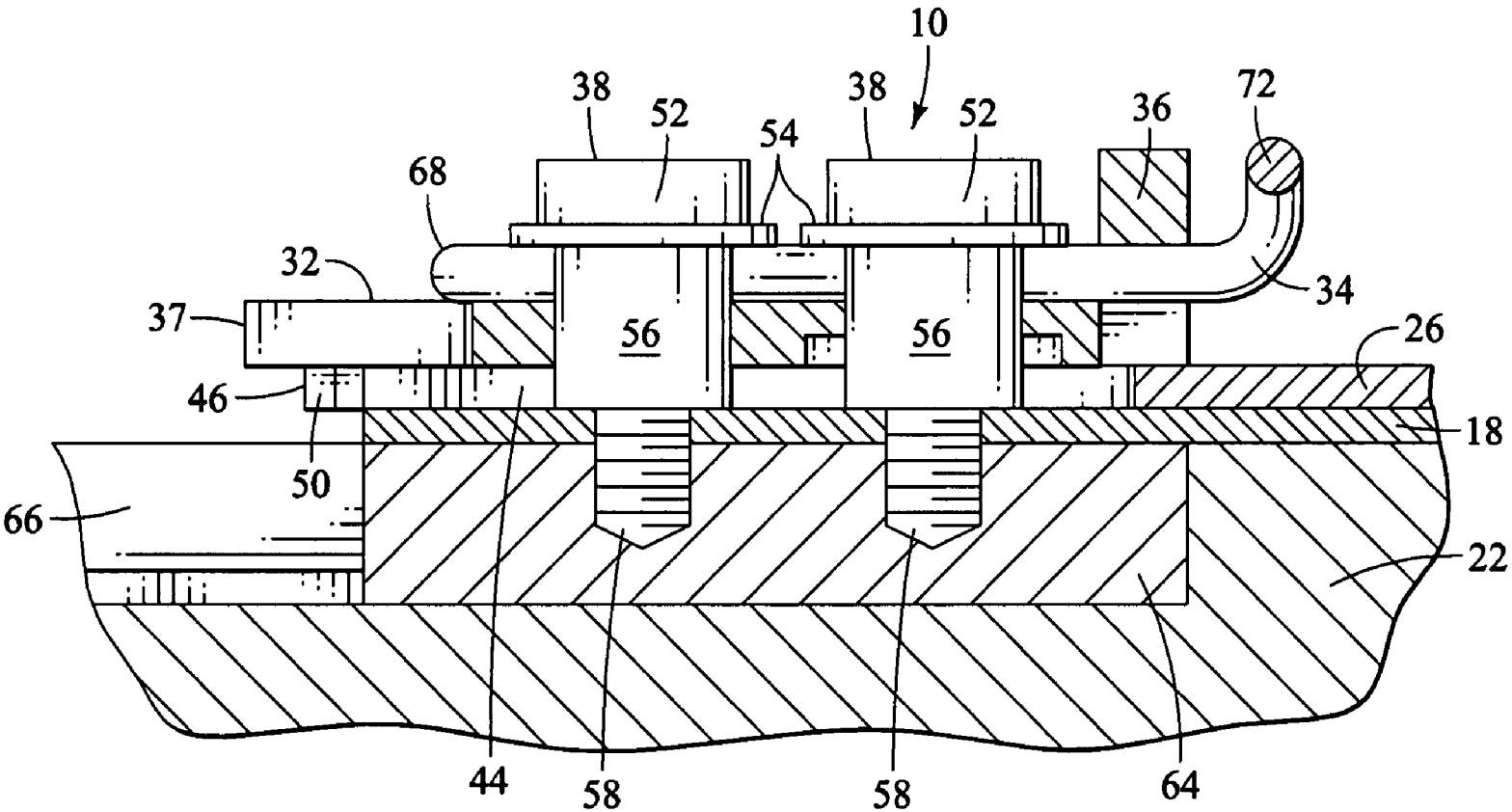
FIG. 5 is a section taken along the line 5—5 of FIG. 1 and in the direction indicated generally.
Figure 6:
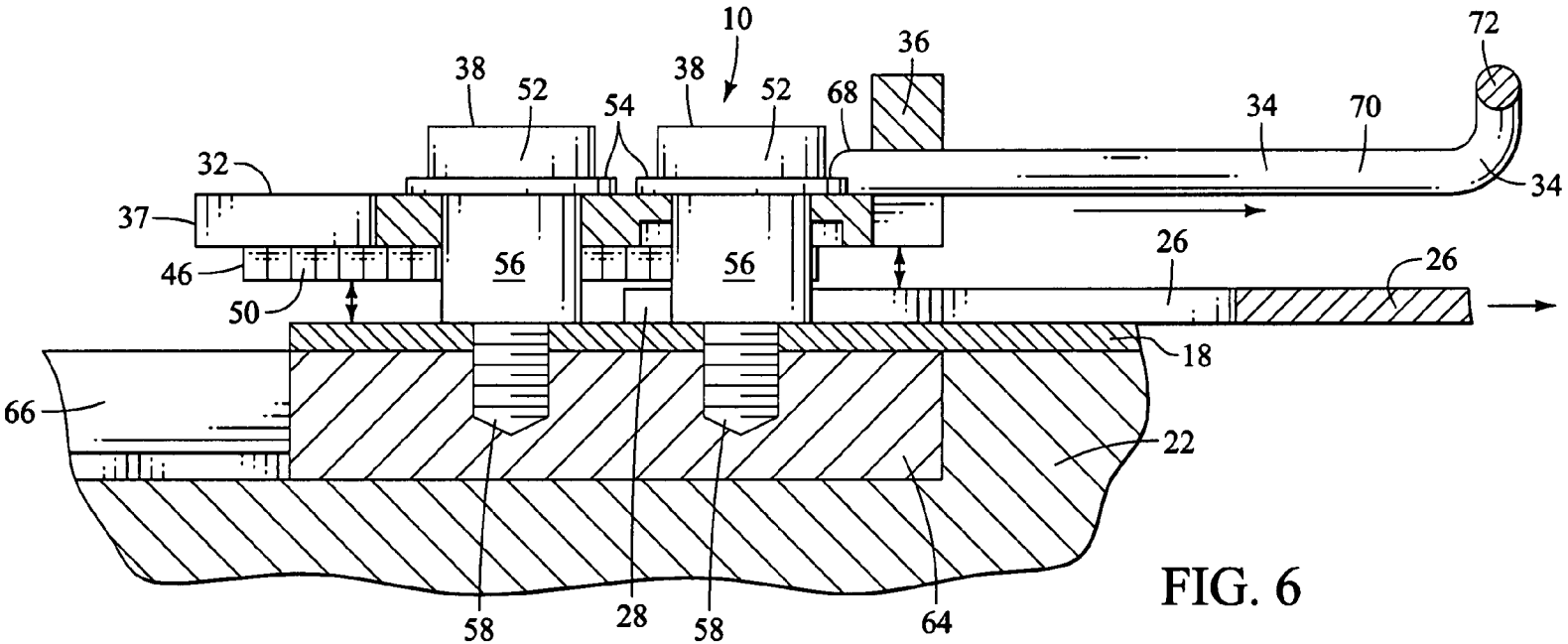
FIG. 6 is a vertical section of the assembly of FIG. 5 shown in the adjustment position.

The present depth of drive assembly 10 extends generally coaxially with the nosepiece 22 and includes a cage stop 32 configured for engaging the tongue portion 28 of the workpiece contact element 26 and securing same relative to the platform 18. The cage stop 32 also retains a spring clip 34 through the use of an eyelet or retaining loop 36. A small gateway or passageway is defined by the eyelet 36 through which the spring clip reciprocates between a closed or locked position (FIGS. 2 and 5) and an open or adjusting position (FIGS. 3 and 6). Opposite the eyelet 36 is at least one and preferably two stops 37 which engage the housing 14 when the workpiece contact element 26 is pressed against a workpiece prior to driving a fastener.

At least one and preferably a pair of studs or locking lugs 38 secure the cage stop 32 to the nosepiece 22 and provide a backing point for clamping force exerted by the spring clip 34 against the cage stop 32, urging it to a clamping or locked position relative to the tongue portion 28.

As will be explained in further detail below, the cage stop 32 is configured for being securable to the tool 12 and is movable between the adjusting position, in which the workpiece contact element 26 is movable relative to the tool 12, and the locked position wherein the adjustment end 28 is secured to the tool. A feature of the present system 10 is that the movement of the cage stop 32, and the associated locking spring clip 34, between the adjusting position and the locking position, is accomplished without the use of tools.

Figure 4:
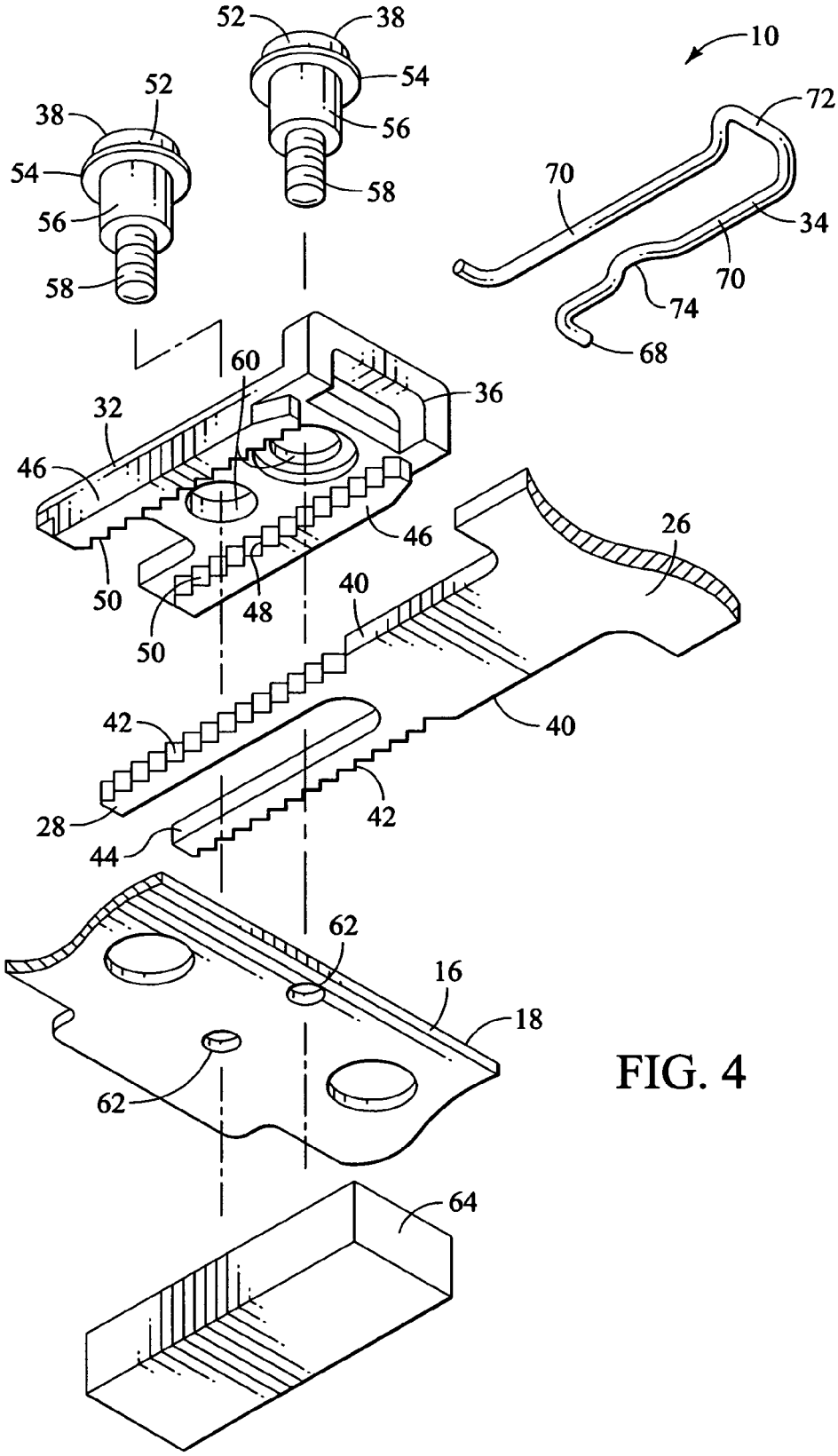
FIG. 4 is an exploded bottom perspective view of the assembly of FIG. 2.

Referring now to FIGS. 3 and 4, it will be seen that the adjustment end 28 is provided with at least one and preferably two edges 40 equipped with an elongate array of teeth 42. The generally "sawtooth"-style teeth 42 face outwardly and the toothed edges 40 diverge from each other. In the preferred embodiment, the generally parallel edges 40 are separated from each other by at least one opening 44. In addition, the cage stop 32 is provided with at least one, and preferably a pair of depending skirts 46 dimensioned to engage the edges 40. The skirts 46 preferably have inner edges 48 each provided with a complementary arrangement of teeth 50 which are configured for meshing with or engaging the teeth 42 on the workpiece contact element 26. In such engagement, the teeth 42 are interspersed between the teeth 50 and vice versa. Once the teeth 42, 50 are engaged, and the cage stop 32 is engaged in the locked position, relative movement of the workpiece contact element 26 and the wire form 16 is prevented. It has been found that the holding power of the present assembly 10 is superior over prior art designs without either weakening the structure of the workpiece contact element or increasing weight of that same component. Furthermore, it is contemplated that the number, spacing, angular orientation and/or configuration of the teeth 42, 50 may vary to suit the application, and any such interlocking configuration permitting the relative adjustable engagement of complementary edges is considered suitable in the present assembly 10. Thus, "teeth" is intended to be broadly defined to include all such configurations.

Referring now to FIG. 4, the locking lugs or studs 38 include an upper head 52 having a hex recess or other formation for receiving a tool, a radially projecting flange 54 at a lower edge of the head, an unthreaded barrel portion 56 and a threaded tip 58. The radially projecting, preferably annular flange 54 is dimensioned for engaging and retaining the generally "U"-shaped spring clip 34 against the cage stop 32 in the locked position (FIGS. 1, 2 and 5). In addition, the barrel portion 56 is configured for slidingly receiving the spring clip 34.

As seen in FIG. 4, the studs 38 pass through respective openings 60 in the cage stop 32, which allow the cage stop to slidably engage the barrel portions 56 in the adjusting position once the spring clip 34 has been withdrawn to the adjusting position. Next, the studs 38 pass through the opening 44 in the workpiece contact element 26, corresponding openings 62 in the platform portion 18 of the wire form 16 and ultimately into a slider block or tie bar 64. The slider block 64 slides relative to a slider block track 66 in the nosepiece 22 (FIGS. 5 and 6).

A feature of the present depth adjustment assembly 10 is that the locking device or spring clip 34 is tethered to the cage stop 32 so that, even in the unlocked or adjusting position, the clip remains associated with the cage stop and as such is not lost. In the preferred embodiment, the tethering takes the form of outwardly angled tips or ends 68 of the spring clip 34, which are preferably oriented at approximate right angles relative to main legs 70 of the clip. The tips 68 are configured to abut against and engage the eyelet 36 when the clip is in the adjusting position (FIGS. 3 and 6).

Another feature of the spring clip 34 is that it has a gripping formation 72 at the opposite end from the tips 68. The gripping formation 72 is preferably bent at a right angle relative to the operational axis of the workpiece contact element 26 and projects sufficiently to facilitate grasping and sliding manipulation by the user without the use of tools. It is contemplated that the angular orientation of the tips 68 and the gripping formation 72 may vary to suit the application. Also, while the gripping formation 72 is shown as a bent portion of wire, it is also contemplated that a pad or cover (not shown) may be provided to further facilitate gripping.

Another feature of the present spring clip 34 is that at least one of the main arms 70 is provided with an indexing bend 74 (best seen in FIGS. 3 and 4) constructed and arranged for nesting between the lugs 38 in the locked position (FIG. 1). The bend 74 is preferably configured to provide the user with a tactile, as well as a visual indication of the clip 34 reaching the locked position.

Figure 7:
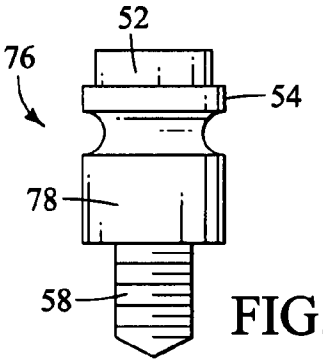
FIG. 7 is a side elevation of an alternate embodiment of a fastener suitable for use with the present assembly.

Referring now to FIGS. 5, 6 and 7, it will be seen that in the locked position, the spring clip 34 engages the lugs 38 in an interference fit to force the cage stop 32 and the adjustment end 28 into the locked position. More specifically, the clip 34 becomes wedged between the radially enlarged flange 54, the unthreaded barrel portion 56 and the cage stop 32. As such, the cage stop 32 is forced against the platform portion 18. Due to the meshed engagement between the teeth 42, 50, axial movement of the workpiece contact element 26 relative to the wire form 16 is prevented.

Referring now to FIG. 7, a modified version of the stud 38 is generally designated 76. Shared components with the stud 38 are designated with identical reference numbers. While in the preferred embodiment the barrel portion 56 is substantially cylindrical, it is also contemplated, as depicted in the stud or lug 76, that a barrel portion 78 may also be provided that is contoured with a grooved or hourglass shape to more closely fit the cross-sectional shape of the wire clip 34. Such a shape accommodates the sliding action of the clip 34 and in some cases facilitates retention relative to the cage stop 32.

Returning to FIGS. 5 and 6, once the respective teeth 42, 50 are in locking engagement, achieved when the teeth 42 of the adjustment end 28 are meshed with the teeth 50 of the skirt 46 and the cage stop 32 is clamped against the platform portion 18, the workpiece contact element 26 cannot move axially relative to the cage stop 32, thus maintaining the desired depth of drive adjustment, even during the stressful environment of repeated combustion events, which is known to cause structural stresses on the workpiece contact element 26. It will be seen that the length of the toothed edge 40 of the adjustment end 28 of the workpiece contact element allows the workpiece contact element to be adjusted axially relative to the cage stop 32 to achieve a variety of depth adjustment positions to account for a variety of workpiece situations and length of fasteners.

In the adjustment position (FIG. 6), once the depth of drive needs adjustment, the user moves the spring clip 34 to disengage the clip from the studs 38, until the tips 68 engage the eyelet 36. This disengagement enables the cage stop 32 to slide relative to the barrel portions 56.

It is contemplated that the present assembly 10 may be provided to users of existing fastener driving tools in the form of a kit of replacement parts. Such a kit includes the workpiece contact element 26 with the toothed adjustment end 28, the cage stop 32 with the toothed skirt 46 and the spring clip locking device 34. The lugs or studs 38, 76 are optionally provided. Thus, the kit as described above is suitable for use with tools 12 designed for the assembly 10, or other tools designed for prior art depth of drive assemblies.

While a particular embodiment of the present tool-less depth adjustment for a fastener-driving tool has been described herein, it will be appreciated by those skilled in the art that changes and modifications may be made thereto without departing from the invention in its broader aspects and as set forth in the following claims.

What is claimed is:

1. An adjustable depth of drive assembly for use with a fastener driving tool, said assembly comprising:

a workpiece contact element having a contact end and an adjustment end;

a cage stop configured for being securable to the tool and being movable between an adjusting position in which said workpiece contact element is movable relative to the tool, and a locked position wherein said adjustment end is secured to the tool;

a locking device associated with said cage stop and configured for being reciprocable between a locked position and an adjustment position for securing said cage stop and said adjustment end in a selected locked position relative to the tool without the use of tools; and at least one anchor lug, said locking device configured for engaging said at least one anchor lug in the locked position, and being released from said at least one lug in the adjustment position.

2. The assembly of claim 1 wherein said locking device is tethered to said cage stop.

3. The assembly of claim 1 wherein said locking device is a spring clip.

4. The assembly of claim 3 wherein said spring clip and said cage stop are configured for retaining said spring clip in said adjustment position.

5. The assembly of claim 3 wherein said spring clip has a gripping formation.

6. The assembly of claim 3 wherein said spring clip has at least one nesting configuration.

7. The assembly of claim 3 wherein said cage stop is provided with a retaining loop, and said spring clip has at least one end configured for engaging said loop.

8. The assembly of claim 1 wherein said locking device engages said at least one lug in an interference fit to force said cage stop and said adjustment end into the locked position.

9. The assembly of claim 1 wherein said adjustment end of said workpiece contact element has at least one toothed edge, and said cage stop has at least one corresponding toothed surface for positively engaging said adjustment end teeth in a plurality of positions.

10. The assembly of claim 9 wherein said cage stop has a depending skirt and said at least one toothed surface is disposed on said skirt.

11. The assembly of claim 10 wherein two, generally parallel side edges of said adjustment end are toothed, and said skirt is provided with teeth for engaging both said edges.

12. An adjustable depth of drive assembly for use with a fastener driving tool, said assembly comprising:

a workpiece contact element having a contact end and an adjustment end having at least one toothed edge; and a cage stop configured for being securable to the tool and being movable between an adjusting position in which said workpiece contact element is movable relative to the tool, and a locked position wherein said adjustment end is secured to the tool, said cage stop having at least one toothed surface for engaging said at least one toothed edge in said locked position; wherein said adjustment end is provided with a pair of outwardly facing toothed edges diverging from each other, and said case stop has a skirt with a pair of inwardly facing toothed surfaces configured for engaging both said toothed edges.

13. The assembly of claim 12 further including at least one fastener for securing said cage stop to the tool so that said cage stop is movable between a relatively loosely secured adjustment position, and a locking position.

14. The assembly of claim 13 further including a locking device selectively engageable with said at least one fastener and said cage stop for maintaining said locking position without the use of tools.

15. The assembly of claim 14 wherein said locking device is a spring clip configured for engaging said cage stop in an interference fit between said stop and said at least one fastener.

16. The assembly of claim 14 wherein said locking device is configured for being retained on said cage stop in said adjustment position.

17. A fastener driving tool, comprising:

a housing;

a wire form reciprocating relative to said housing between an extended position and a retracted position;

a workpiece contact element having a contact end and an adjustment end having at least one toothed edge;

a cage stop configured for being securable to said tool and being movable between an adjusting position in which said workpiece contact element is movable relative to said wire form, and a locked position wherein said adjustment end is secured to said wire form for movement therewith said cage stop having at least one toothed surface for engaging said at least one toothed edge in said locked position; and a locking device associated with said cage stop and configured for being reciprocable between a locked position and an adjustment position for securing said cage stop and said adjustment end in a selected locked position relative to said tool without the use of tools, said locking device being selectively engageable in an interference fit with at least one fastener and said cage stop for maintaining said locked position without the use of tools.

* * * * *